US005934345A

United States Patent [19]

Moynihan et al.

[11] Patent Number: 5,934,345

[45] Date of Patent: Aug. 10, 1999

[54] OUTLET FITTING AND CONTAINER HAVING THE SAME AND METHOD FOR CONTAINING A MATERIAL AND DRAINING AND FILLING THE SAME

[75] Inventors: Craig A. Moynihan; James A. Nowak, both of Naperville; Robert W. Beazley, St. Charles, all of Ill.

[73] Assignee: Nalco Chemical Company, Naperville, Ill.

[21] Appl. No.: 09/003,321

[22] Filed: Jan. 6, 1998

[51] Int. Cl.[6] ..... B65B 1/04

[52] U.S. Cl. ..... 141/313; 141/114; 222/105; 222/527

[58] Field of Search ..... 141/114, 313, 141/314, 10; 222/105, 527

[56] References Cited

U.S. PATENT DOCUMENTS

| | | | |
|---|---|---|---|
| 3,081,911 | 3/1963 | Scholle | 222/105 |
| 4,746,034 | 5/1988 | Ata et al. . | |
| 4,921,147 | 5/1990 | Poirier | 222/527 |
| 5,016,666 | 5/1991 | McKinney et al. . | |
| 5,029,602 | 7/1991 | McKinney et al. . | |
| 5,072,857 | 12/1991 | Coleman | 222/105 |
| 5,126,729 | 6/1992 | McKinney et al. . | |
| 5,195,661 | 3/1993 | Light | 222/105 |

*Primary Examiner*—Steven O. Douglas
*Attorney, Agent, or Firm*—Hill & Simpson

[57] ABSTRACT

A fitting is provided for attachment to a flexible bag. The combined flexible bag and fitting may be inserted into a container for filling the flexible bag with a material, such as a chemical requiring transport, and ultimately draining of the material following delivery thereof. The fitting allows for bottom filling of the container and elimination of head space as well as draining of the material without interference from the bag.

13 Claims, 2 Drawing Sheets

OUTLET FITTING AND CONTAINER HAVING THE SAME AND METHOD FOR CONTAINING A MATERIAL AND DRAINING AND FILLING THE SAME

BACKGROUND OF THE INVENTION

The present invention provides a fitting for attachment to a flexible bag as well as providing an assembly for transporting materials within a container. Also, the present invention provides a method for carrying a material within a container which provides for bottom-filling of the container thereby eliminating head space. In addition, the present invention provides a method for draining the material without interference from the bag holding the material within the container.

It is, of course, generally known to provide containers for shipping or transporting of materials, such as chemicals. Often, large volumes of chemicals are transported within such containers. The containers may often be constructed from steel which may be incompatible with the chemicals within the container. In such situations, it is known to use plastic bottles within steel containers for holding the chemicals.

Another alternative to prevent incompatibility is to line the steel containers with polyethylene in order to transport chemicals incompatible with the steel containers in which the materials are shipped. However, often such a lining is cracked and results in waste of the materials within the steel containers due to the cracked lining. Moreover, repair of the units may be extemely time-consuming and expensive. As a result, a shortage of lined units exists affecting inventory and delivery of chemicals or other materials to customers.

In addition, during filling of containers with chemicals, an air gap may be produced between the top of the product and the upper wall of the bag. As a result, specific products, such as latex polymer products, have problems with condensation in the air gap which may affect or may even destroy a product's quality. Furthermore, when a bag is used within a container and the product or chemical within the container is drained, often, the bag may be sucked into an outlet port of the container preventing drainage of the material from the bag.

A need, therefore, exists for an improved fitting and container attached to the fitting as well as a method for carrying a material including filling and draining the material from the container.

SUMMARY OF THE INVENTION

The present invention provides a fitting, a combined assembly of a bag and a fitting for use in sharing materials, and a method for carrying a material including filling and draining the material from the container.

To this end, in an embodiment, the present invention provides a fitting having a tubing with rigid, flexible exterior walls forming an interior passageway and having a substantially uniform diameter along a length of the tubing wherein the length of the tubing is defined between a first end and a second end. A first flange is connected to the first end of the tubing, and a second flange is connected to the second end of the tubing.

In an embodiment, a stand-off is attached at the first end of the tubing and has a diameter greater than the diameter of the tubing.

In an embodiment, the first flange has a diameter greater than a diameter of the second flange.

In an embodiment, the first flange and the second flange are constructed from polyethylene.

In an embodiment, the first flange has a thickness greater than a thickness of the second flange.

In an embodiment, the standoff has a plurality of legs wherein each of the legs attaches to the tubing at the first end.

In an embodiment, the exterior walls of the tubing are corrugated.

In another embodiment of the present invention, a combined assembly of a bag and a fitting for use in carrying materials is provided. The assembly has a flexible bag having exterior walls defining an interior volume wherein the bag is capable of holding materials. A fitting is attachable to a wall of the flexible bag wherein fluid communication is provided between the fitting and the interior volume of the flexible bag and further wherein the fitting has a length of flexible, rigid tubing defined between a first end and a second end having a first flange at the first end that attaches to the bag and a second flange at the second end.

In an embodiment, a stand-off is connected at the first end of the tubing.

In an embodiment, the first flange and the second flange each have a diameter greater than a diameter of the tubing.

In an embodiment, the first flange has a diameter greater than a diameter of the second flange.

In an embodiment, the first flange is constructed from polyethylene and has a thickness greater than a thickness of the second flange.

In an embodiment, the second flange is constructed from polyethylene and has a thickness less than a thickness of the first flange.

In an embodiment, the bag has a thickness less than the first flange or the second flange.

In another embodiment of the present invention, a method is provided for carrying a material. The method comprises the steps of: providing a container having exterior walls defining an interior volume wherein the container has a port at a base of the container; inserting a flexible bag in the interior of the container wherein the flexible bag has a fitting attached thereto wherein the fitting provides fluid communication with the flexible bag through the port; and filling the flexible bag with the material through the fitting extending through the port.

In another embodiment, the material is drained from the flexible bag through the fitting extending through the port.

In an embodiment, a stand-off is attached at a location at which the fitting attaches to the flexible bag.

In an embodiment, a flange is connected between the fitting and the port.

In an embodiment, a flange is connected between the fitting and the flexible bag.

In an embodiment, the fitting includes a rigid flexible tubing.

It is, therefore, an advantage of the present invention to provide a fitting, an assembly of a bag and a fitting and a method for carrying a material that provides simple filling and draining of material within a container.

Another advantage of the present invention is to provide a fitting, a combined fitting and bag and a method for carrying a material that eliminates head space in the container containing the material.

Yet another advantage of the present invention is to provide a fitting, a combined assembly of a bag and fitting, and a method for carrying a material that may be simply installed into a container for transport of the bag containing the material.

Moreover, an advantage of the present invention is to provide a fitting a combined assembly of a bag a fitting, and a method for carrying a material that is inexpensive to implement.

A still further advantage of the present invention is to provide a fitting, a combined assembly of a bag and a fitting, and a method for carrying a material that prevents damage to the material during transport.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a fitting and a container having the fitting attached thereto as well as a method for transporting or carrying a material using the container and fitting to assist in filling and draining of the same.

Figure 1:
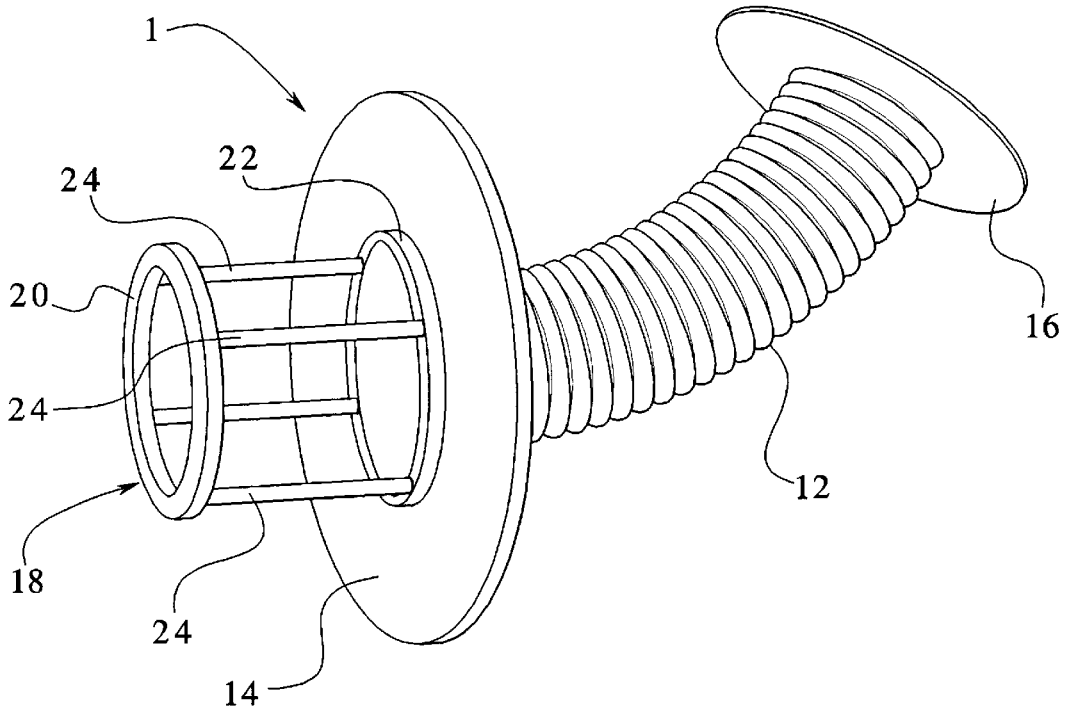
FIG. 1 illustrates a perspective view of an embodiment of a fitting of the present invention.
Figure 2:
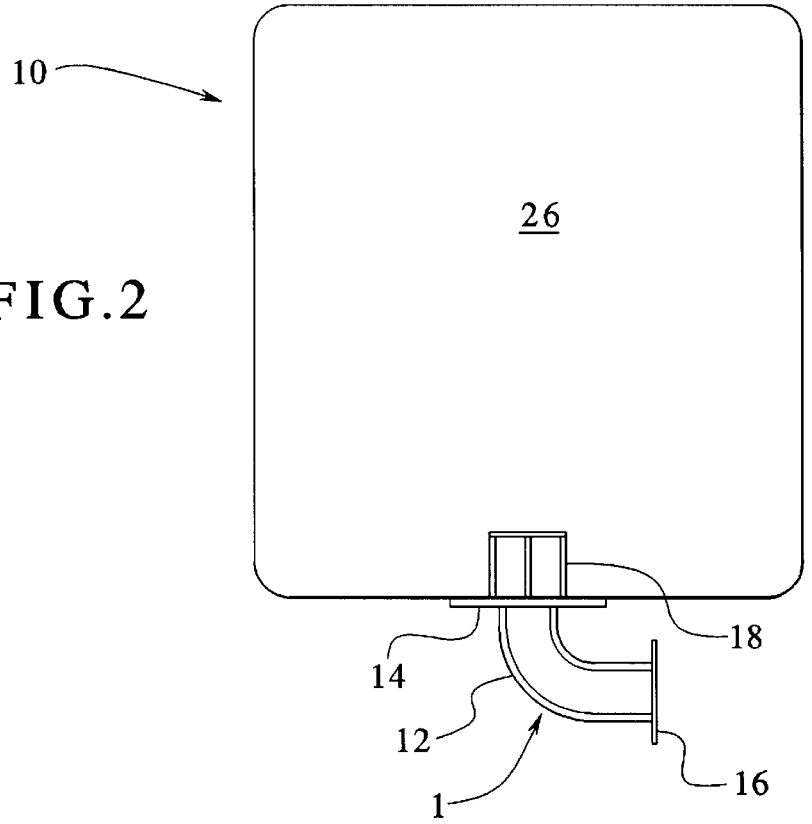
FIG. 2 illustrates a plan view of a container attached to an embodiment of a fitting of the present invention.

Referring now to the drawings wherein like numerals refer to like parts, FIG. 1 generally illustrates a fitting 1 of the present invention. The fitting 1 may be attached to a container or flexible bag 10 as generally illustrated in FIG. 2. The fitting 1 includes a length of rigid, but flexible, tubing 12 that is preferably constructed from a linear low-density polyethylene material. The flexible suction tubing 12 preferably has an outer diameter of approximately one inch. Of course, various sizes and lengths of tubing may be implemented by those skilled in the art depending on the particular application in which the same is required.

In a preferred embodiment, the tubing 12 has a first flange 14 connected at a first end of the tubing 12. A second flange 16 is connected at an opposite end of the tubing 12. Preferably, the flanges 14,16 are polyethylene welded to the flexible suction tubing 12. Further, the materials from which each of the tubing 12 and the flanges 14,16 are constructed are preferably linear low-density polyethylene. The diameter of the first flange 14 is preferably larger than the diameter of the second flange 16. In a preferred embodiment, the diameter of the first flange 14 is approximately six inches, and the diameter of the second flange 16 is approximately four inches. As further illustrated, the thickness of the first flange 14 is greater than the thickness of the second flange 16. Preferably, the thickness of the first flange is 30 mil; and, the thickness of the second flange is 8 mil. The second flange 16, therefore, acts or is implemented as a gasket in its operation which will be described hereinafter with reference to FIG. 3.

As further illustrated in FIG. 1, a stand-off 18 may be provided and attached to the flange 14. Alternatively, the stand-off 18 may be directly attached to the tubing 12. In a preferred embodiment, the stand-off 18 has a diameter greater than the tubing 12. The stand-off 18 includes a first end 20 and a second end 22 separated and attached by a plurality of legs 24. The legs 24 are spaced about a periphery of the stand-off 18 such that fluid is capable of entering the stand-off 18 and ultimately entering through the tubing 12. The purpose of the stand-off will be described further with reference to FIGS. 2 and 3. The stand-off 18 may be constructed from a linear low-density polyethylene material and polyethylene welded to the first flange 14.

Referring now to FIG. 2, the container 10 is attached to the fitting 1 so as to provide fluid communication between the passageway formed in the tubing 12 of the fitting 1 and an interior 26 of the flexible bag 10. The interior 26 of the container 10 is preferably empty prior to insertion into a portable liquid container, such as a container generally shown and described in commonly assigned U.S. Pat. No. 4,746,034, the disclosure of which is incorporated herein by reference in its entirety. As shown, the flange 14 attaches to an exterior wall of the container 10. The flange 14 may be polyethylene welded to the container 10 in the position illustrated. The stand-off 18 may extend into the interior 26 of the container 10. When the interior 26 of the flexible bag 10 is drained, the stand-off 18 prevents the flexible bag 10 from interfering with solutions or other material draining from the interior 26 into the tubing 12.

Figure 3:
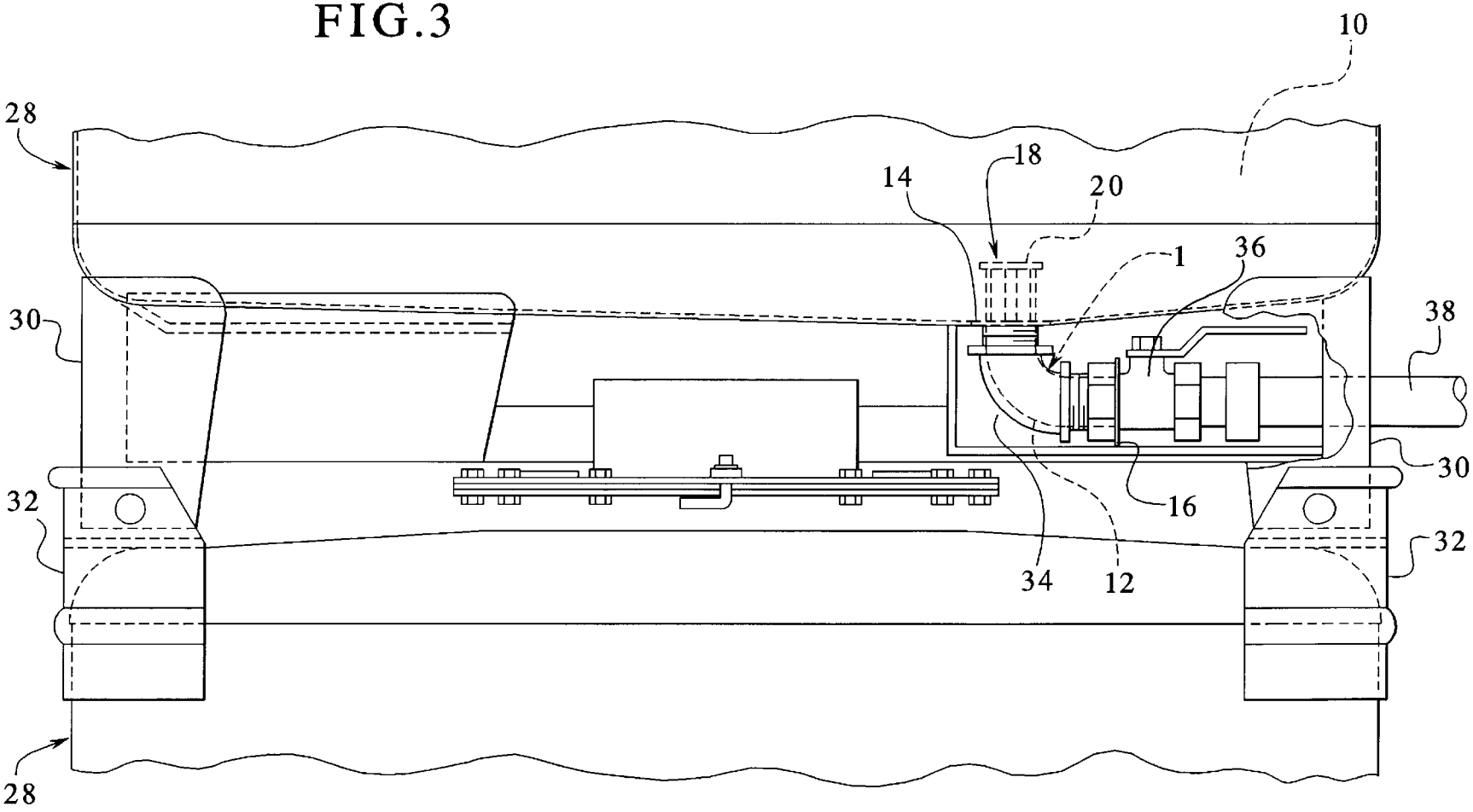
FIG. 3 illustrates a sectional view of an embodiment of a fitting of the present invention within a container used to transport the material.

Referring now to FIG. 3, a bottom section of an enclosed container 28 is generally illustrated. The enclosed container 28 may be any type of container that is generally implemented for transporting materials, such as liquid chemicals.

As shown, the containers 28 are designed such that one container 28 may be stacked on top of another container 28. To this end, legs 30 are provided and extending from one end of a base of the container 28 and are received in leg positioners 32 positioned on a top side of an adjacent enclosed container 28.

As further illustrated, a flexible bag 10 may be inserted into the interior of the enclosed container 28. The flexible bag 10 includes the fitting 1 attached thereto. The fitting 1 is secured to the containers 10 such that the fitting 1 may be extended to the position illustrated in FIG. 3. As shown, the fitting 1 extends such that the tubing 12 is positioned at a point within an outlet elbow 34 of the enclosed container 28. The outlet elbow 34 is operatively connected to a valve mechanism 36 and tubing 38 such that, when the valve mechanism 36 is opened, a liquid or other material may be inserted into the flexible bag 10 or drained from the flexible bag 10 by, for example, a pump. The flexible rigid tubing 12 allows use of the fitting 1 within the outlet elbow 34 and further provides discharge pumping from the container 10 without pump cavitation or bag collapse. The flanges 14, 16 provide a sealing surface between the components of the system preventing leaks and further permitting easy installation of the fitting 1 through the outlet elbow 34 and ultimately connection to the valve mechanism 36 and the outlet tubing 38.

In operation, the flexible bag 10 is filled by opening the valve mechanism 36 and pumping fluid or other material through the outlet tubing 38 and the fitting 1 into the interior 26 of the flexible bag 10. Following transport, the flexible bag 10 may require draining. A reverse operation is conducted by opening the valve mechanism 36 and draining the contents within the interior of the flexible bag 10 through the tubing 12 and further through the outlet tubing 38 to the desired destination. The stand-off 18 prevents the flexible bag 10 from being sucked into the outlet tubing 38 thereby permitting complete drainage of the interior of the bag 10. Furthermore, the fitting 1 is designed to permit installation of the liner in an application that requires bottom filling of the flexible bag 10 which is generally dependent on the type of material or chemical being transported. The fitting 1 allows for installation of a bottom filled bag which had previously been impractical.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A fitting comprising:

tubing having rigid, flexible exterior walls forming an interior passageway and having a diameter along a length of the tubing wherein the length of the tubing is defined between a first end and a second end;

a first flat, annular flange connected to the first end of the tubing;

a second flange connected to the second end of the tubing;

a standoff attached at the first flange with the first flange disposed between the standoff and the first end of the tubing, the standoff having an inner diameter greater than an inner diameter of the tubing;

the first and second flanges having diameters greater than an outer diameter of the tubing; and the standoff comprising a first ring-shaped open end and a second open end with a plurality of spaced apart connecting legs disposed therebetween and connecting the first open end to the second open end, the second open end being connected to the first flange.

2. The fitting of claim 1 wherein the first flange has a diameter greater than a diameter of the second flange.

3. The fitting of claim 1 wherein the first flange and the second flange are constructed from polyethylene.

4. The fitting of claim 1 wherein the first flange has a thickness greater than a thickness of the second flange.

5. The fitting of claim 1 wherein the exterior walls of the tubing are corrugated.

6. A combined assembly of a bag and a fitting for use in carrying materials, the assembly comprising:

a flexible bag having exterior walls defining an interior volume wherein the bag is capable of holding materials; and a fitting attachable to a wall of the flexible bag wherein fluid communication is provided between the fitting and the interior volume of the flexible bag and further wherein the fitting has a length of flexible, rigid tubing defined between a first end and a second end having a first flat, annular flange at the first end that attaches to the bag and a second flange at the second end, the first and second flanges having outer diameters greater than an outer diameter of the tubing, the fitting further comprising a standoff connected at the first end of the tubing with the first flange disposed between the standoff and the first end of the tubing, the standoff having an inner diameter that is greater than an inner diameter of the tubing, the standoff comprising a first ring-shaped open end and a second open end with a plurality of spaced apart connecting legs disposed therebetween and connecting the first open end to the second open end, the second open end being connected to the first end of the tubing.

7. The assembly of claim 6 wherein the first flange and the second flange each have a diameter greater than a diameter of the tubing.

8. The assembly of claim 6 wherein the first flange has a diameter greater than a diameter of the second flange.

9. The assembly of claim 6 wherein the first flange is constructed from polyethylene and has a thickness greater than a thickness of the second flange.

10. The assembly of claim 6 wherein the second flange is constructed from polyethylene and has a thickness less than a thickness of the first range.

11. The assembly of claim 6 wherein the bag has a thickness less than the first flange or the second flange.

12. A fitting comprising:

tubing having rigid, flexible exterior walls forming an interior passageway and having a diameter along a length of the tubing wherein the length of the tubing is defined between a first end and a second end;

a first flat, annular flange connected to the first end of the tubing;

a second flange connected to the second end of the tubing;

a standoff attached at the first flange with the first flange disposed between the standoff and the first end of the tubing, the standoff having an inner diameter greater than an inner diameter of the tubing;

the first and second flanges having diameters greater than an outer diameter of the tubing; and the standoff comprising a first ring-shaped open end and a second open end with a plurality of spaced apart connecting legs disposed therebetween and connecting the first open end to the second open end, the second open end being connected to the first end of the tubing.

13. A combined assembly of a bag and a fitting for use in carrying materials, the assembly comprising:

a flexible bag having exterior walls defining an interior volume wherein the bag is capable of holding materials; and a fitting attachable to a wall of the flexible bag wherein fluid communication is provided between the fitting and the interior volume of the flexible bag and further wherein the fitting has a length of flexible, rigid tubing defined between a first end and a second end having a first flat, annular flange at the first end that attaches to the bag and a second flange at the second end, the first and second flanges having outer diameters greater than an outer diameter of the tubing, the fitting further comprising a standoff connected at the first end of the tubing with the first flange disposed between the standoff and the first end of the tubing, the standoff having an inner diameter that is greater than an inner diameter of the tubing, the standoff comprising a first ring-shaped open end and a second open end with a plurality of spaced apart connecting legs disposed therebetween and connecting the first open end to the second open end, the second open end being connected to the first flange.

* * * * *